US009682011B2

(12) United States Patent
Zhang

(10) Patent No.: US 9,682,011 B2
(45) Date of Patent: Jun. 20, 2017

(54) MOVABLE MEDICAL CASE

(71) Applicant: WUXI ROBUST MEDICAL CO., LTD., Wuxi, Jiangsu (CN)

(72) Inventor: Tianle Zhang, Jiangsu (CN)

(73) Assignee: WUXI ROBUST MEDICAL CO., LTD., Wuxi, Jiangsu (CN)

( * ) Notice: Subject to any disclaimer, the term of this patent is extended or adjusted under 35 U.S.C. 154(b) by 0 days.

(21) Appl. No.: 15/103,330

(22) PCT Filed: May 11, 2015

(86) PCT No.: PCT/CN2015/078639

§ 371 (c)(1),
(2) Date: Jun. 10, 2016

(87) PCT Pub. No.: WO2015/176612

PCT Pub. Date: Nov. 26, 2015

(65) Prior Publication Data

US 2016/0310361 A1 Oct. 27, 2016

(30) Foreign Application Priority Data

May 20, 2014 (CN) ..... 2014 1 0211831

(51) Int. Cl.
*A61J 7/00* (2006.01)
*A61G 12/00* (2006.01)
(Continued)

(52) U.S. Cl.
CPC ..... *A61J 1/00* (2013.01); *A47B 67/02* (2013.01); *A47B 88/40* (2017.01); *A47B 88/407* (2017.01);
(Continued)

(58) Field of Classification Search
CPC . A47B 88/0477; A47B 88/0414; A47B 67/02; A47B 88/457; A47B 88/463;
(Continued)

(56) References Cited

U.S. PATENT DOCUMENTS 3,005,672 A * 10/1961 Becker ..... A47B 88/0414 312/319.7
3,019,070 A * 1/1962 Dieboid ..... A47B 88/0414 312/319.7
(Continued)

FOREIGN PATENT DOCUMENTS

CN 201070133 6/2008
CN 101668455 3/2010
(Continued)

OTHER PUBLICATIONS

International Search Report of PCT/CN2015/078639 dated Aug. 20, 2015, 6 pages. (English and Chinese).

*Primary Examiner* — Leslie A Nicholson, III
*Assistant Examiner* — Kimberley S Wright
(74) *Attorney, Agent, or Firm* — Rankin, Hill & Clark LLP

(57) ABSTRACT

A movable medical case includes a medical case housing, a medicine box and drawers. The drawers are installed inside the medicine box. The medicine box is installed inside the medical case housing. Drawer driving devices are installed in the medical case housing. The drawer driving devices pass through the medicine box and are detachably connected with the drawers, and the drawers are driven to get out of or enter the medical case housing.

6 Claims, 8 Drawing Sheets

(51) Int. Cl.

| | |
|---|---|
| ***A47B 88/00*** | (2017.01) |
| ***A61J 1/00*** | (2006.01) |
| ***A47B 67/02*** | (2006.01) |
| ***A47B 95/02*** | (2006.01) |
| ***A47B 88/40*** | (2017.01) |
| ***A47B 88/407*** | (2017.01) |
| ***A47B 88/457*** | (2017.01) |
| ***A47B 88/47*** | (2017.01) |
| ***A47B 88/487*** | (2017.01) |

(52) U.S. Cl.
CPC ..... *A47B 88/457* (2017.01); *A47B 88/47* (2017.01); *A47B 88/487* (2017.01); *A47B 95/02* (2013.01); *A47B 2095/022* (2013.01); *A61G 12/001* (2013.01)

(58) Field of Classification Search
CPC ..... A47B 88/00; A47B 88/04; E05Y 2900/20; A61G 12/001; G07F 17/0092; G07F 11/62
See application file for complete search history.

(56) References Cited

U.S. PATENT DOCUMENTS 3,298,765 A * 1/1967 Rakich ..... A47B 63/02 109/45
3,847,301 A * 11/1974 Shaw ..... A47F 1/12 221/5
4,019,793 A * 4/1977 Gerding ..... A61J 7/0069 312/209
4,324,439 A * 4/1982 Hagen ..... A47B 88/10 312/331
4,828,344 A * 5/1989 Omata ..... A47B 88/047 312/319.1
5,087,107 A * 2/1992 Fumanelli ..... E05G 5/006 312/249.11
5,158,347 A * 10/1992 Warren ..... A47B 88/0414 312/319.8
5,651,596 A * 7/1997 Carlson ..... A47B 88/20 220/533
5,785,402 A * 7/1998 DeLorenzo ..... A47B 67/04 312/246
5,803,559 A * 9/1998 Carlson ..... E05B 65/462 312/216
5,805,075 A * 9/1998 Carlson ..... A61G 12/001 312/215
5,915,803 A * 6/1999 Daugherty ..... A47B 46/00 312/263
6,371,584 B1 * 4/2002 Alreck ..... A47B 67/04 177/144
6,409,622 B1 * 6/2002 Bolz ..... F02N 15/046 475/290
6,643,091 B2 * 11/2003 Coffin ..... G11B 15/6835 360/92.1
7,780,251 B2 * 8/2010 Dubach ..... A47B 88/0414 312/319.1
7,868,578 B2 * 1/2011 Scheffknecht ..... A47B 67/04 318/466
8,152,250 B2 * 4/2012 Aguilar Ante ..... A47B 88/04 312/331
8,196,939 B2 * 6/2012 Bustle ..... A47B 21/0314 280/47.35
8,344,670 B2 * 1/2013 Gassner ..... A47B 88/0481 242/390
8,731,958 B2 * 5/2014 Barrett ..... G06F 19/3456 705/2
9,016,813 B2 * 4/2015 Moody ..... F25D 25/025 312/331
9,081,887 B2 * 7/2015 Olson ..... G07F 17/0092
9,187,043 B2 * 11/2015 Doll ..... A47B 88/14
2004/0100169 A1 * 5/2004 Huber ..... A47B 88/0414 312/319.5
2006/0214547 A1 * 9/2006 Bonner ..... A47B 88/047 312/319.5
2006/0220507 A1 * 10/2006 Steele ..... A47B 47/05 312/330.1
2007/0180654 A1 * 8/2007 Gasser ..... A47B 88/0414 16/242
2008/0111455 A1 * 5/2008 Fitz ..... A47B 88/02 312/319.5
2008/0191591 A1 * 8/2008 Blucher ..... A47B 88/0414 312/319.1
2008/0290774 A1 * 11/2008 Gasser ..... A47B 88/0414 312/330.1
2009/0102338 A1 * 4/2009 Wenzel ..... A47B 88/0477 312/319.1
2009/0212670 A1 * 8/2009 Bustle ..... A47B 21/0314 312/209
2010/0037715 A1 * 2/2010 Gasser ..... A47B 88/0477 74/27
2010/0084953 A1 * 4/2010 Schneider ..... A47B 88/0477 312/319.1
2010/0106291 A1 * 4/2010 Campbell ..... E05B 47/0002 700/231
2010/0114367 A1 * 5/2010 Barrett ..... G06F 19/3456 700/236
2010/0176699 A1 * 7/2010 Biba ..... G07F 11/18 312/319.1
2010/0219727 A1 * 9/2010 Aguilar Ante ..... A47B 88/04 312/319.1
2011/0241509 A1 * 10/2011 Ahlfeld ..... A47B 88/0414 312/294
2012/0280600 A1 * 11/2012 Noel ..... A47F 7/286 312/139
2013/0140970 A1 * 6/2013 Dubach ..... A47B 88/0477 312/319.1
2013/0169132 A1 * 7/2013 Johnson ..... A47B 88/70 312/298
2013/0221821 A1 * 8/2013 Taimler ..... A47B 88/0477 312/334.1
2015/0042217 A1 * 2/2015 Olson ..... A47B 67/02 312/209
2015/0250312 A1 * 9/2015 Barrett ..... A47B 88/0414 312/319.1
2016/0206093 A1 * 7/2016 Brunnmayr ..... A47B 88/0477

FOREIGN PATENT DOCUMENTS

| | | |
|---|---|---|
| CN | 201641070 | 11/2010 |
| CN | 201906213 | 7/2011 |
| CN | 202342503 | 7/2012 |
| CN | 104003048 | 8/2014 |

* cited by examiner

MOVABLE MEDICAL CASE

TECHNICAL FIELD

The present invention relates to the field of medical device manufacturing technologies, and more particularly, to a movable medical case.

BACKGROUND

A mobile medical computer workstation is mainly used for collecting, managing and sharing information data in the hospital, and helping medical staff nurse and treat patients. This technology is being applied extended and applied to other business areas gradually. Its function is to integrate a computer and external equipments thereof (such as a bar code scanner) and common inspection equipment (such as monitors for blood pressure, blood oxygen, temperature and heart rate) into a removable workbench equipped with a standby power supply. The medical staff push the workbench to a ward, and input the information checked into the computer at the bedside and store the information into a data base of the hospital through wireless networking, so as to achieve the objects of quickly and accurately collecting and integrating the data of the patients; according to the medical advice, a nurse can use the movable medical computer workstation to complete the job of distributing medicines to the patients. The medical case is placed in the top surface of the workbench, and can be entirely taken out. The medical staff take the medical case to dispense medicines for each patient at a dispensing station. Then the medical case is replaced into the workstation after the medicines are loaded.

SUMMARY

Aiming at the defects of the prior art, the present invention provides a movable medical case having a medicine box which is simple in structure, and reasonable in arrangement, wherein there is not any electrical connection between the medicine box and the medical case, which increases the universality, and enables the medicine box to be replaced more conveniently and quickly. The movable medical case is applicable to the automation control demands of a mobile medical computer workstation.

To fulfill the foregoing object, the present invention adopts the following technical solutions.

A movable medical case includes a medical case housing, a medicine box and drawers, wherein:

the drawers are installed inside the medicine box, the medicine box is installed inside the medical case housing, and drawer driving devices are installed in the medical case housing, the drawer driving devices pass through the medicine box and are detachably connected with the drawers, and drive the drawers to get out of or enter the medical case housing.

Further, the medicine box is detachably connected with the medical case housing.

Further, a coupling mechanism is installed at the rear end of the drawer, the drawer driving device is installed on the side wall inside the medical case housing, including a motor, a synchronous belt, two synchronous belt wheels and a coupling rod, the motor is installed in the medical case housing to drive the synchronous belt wheels to rotate so as to drive the synchronous belt to move, and the coupling rod is installed in the synchronous belt and is detachably matched with the coupling mechanism.

Further, the drawer driving device also includes a guide rod and a coupling rod fixed mount, wherein the guide rod is installed above the synchronous belt and is fixed in the side wall of the medical case housing, the coupling rod fixed mount includes a sliding block sheathed on the guide rod and a coupling rod pedestal fixed in the bottom portion of the sliding block, the synchronous belt is clamped between the sliding block and the coupling rod fixed mount, and the coupling rod is fixed in the coupling rod pedestal.

Further, the coupling mechanism includes a bracket, a hook plate and a return spring, wherein:

the bracket is a plate with a U-shaped cross section, wherein an opening thereof faces towards the rearward of the drawer, and a bottom portion thereof is fixed in the rear end of the drawer, the hook plate includes an articulation portion, a connecting portion and a wedged-head portion, the articulation portion is located at the lower portion of the hook plate and is articulated with the lower portion of the bracket, the connecting portion and the wedged-head portion are located at the top portion of the hook plate, the connecting portion is located at one side close to the bracket, a holding groove is formed between the connecting portion and the wedged-head portion, and the holding groove is matched with the coupling rod, and the return spring is installed at the top portion inside the bracket, the position of the return spring is corresponding to the position of the connecting portion, one end of the return spring is fixed in the bracket, and the other end is connected with the connecting portion.

Further, the portion of the holding groove close to the wedged-head portion forms an arc bent towards the inside of the holding groove.

Further, the portion of the holding groove close to the wedged-head portion forms an arc bent towards the inside of the holding groove.

The movable medical case according to the present invention may implement detachable connection between the medical case housing and the medicine box. When the medical case is installed in a workstation, the medicine box may be taken out to dispense medicines at a dispensing station, and then put back to the medical case. When the medical case is installed in the medical case housing, the drawers may be ejected automatically by controlling the drawer driving devices; when the medicine box needs to be taken out of the medical case housing or putted into the medical case housing, the automatic separation and connection between the drawers and the drawer driving devices can also be implemented. The medical case is simple in structure, and reasonable in arrangement, and is applicable to the automation control demands of the mobile medical computer workstation.

DETAILED DESCRIPTION

The present invention will be further illustrated hereinafter with reference to the drawings. It should be appreciated that the embodiments are for explanation only, but not intended to restrict the scope of the present invention. Various equivalent modifications figured by those skilled in the art after reading the present invention shall all fall within the range defined by the claims of the present application appended.

Figure 1:
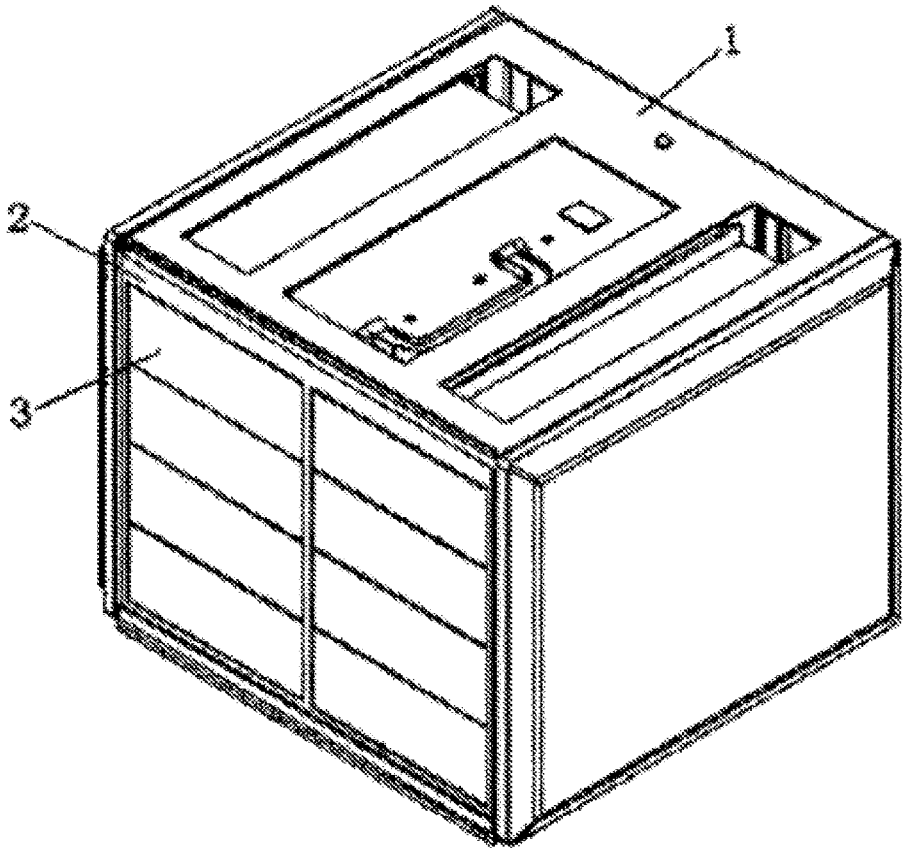
FIG. 1 is a schematic diagram of a movable medical case according to the invention.
Figure 2:
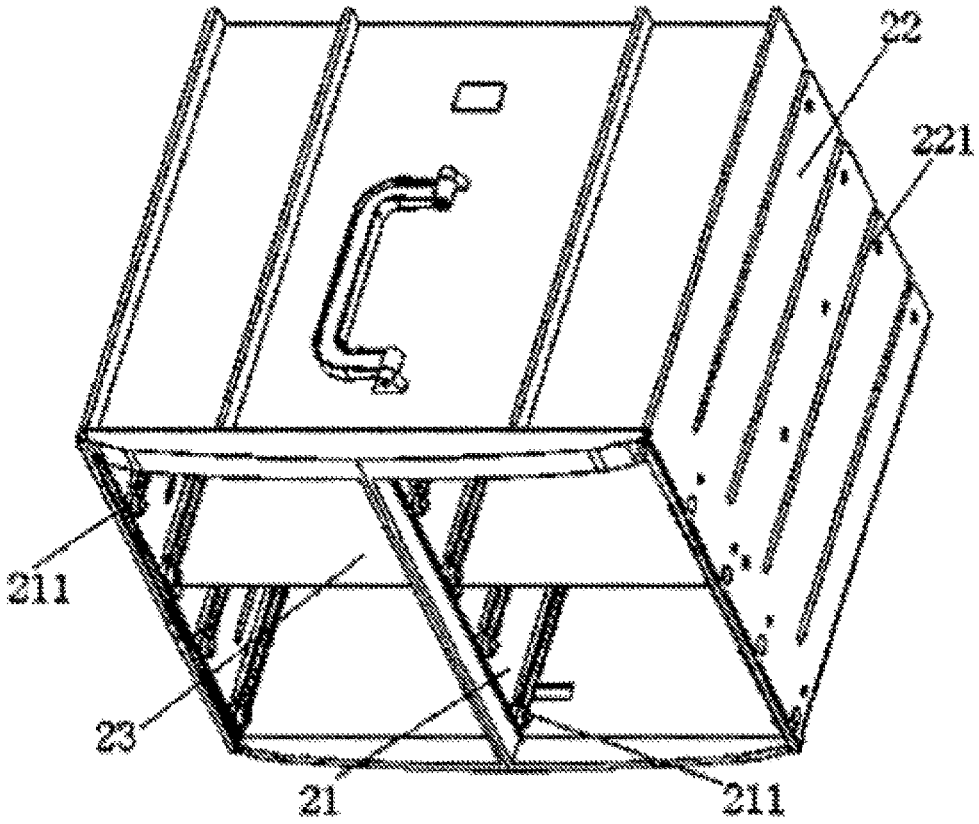
FIG. 2 is a schematic diagram of a medicine box according to the present invention.
Figure 3:
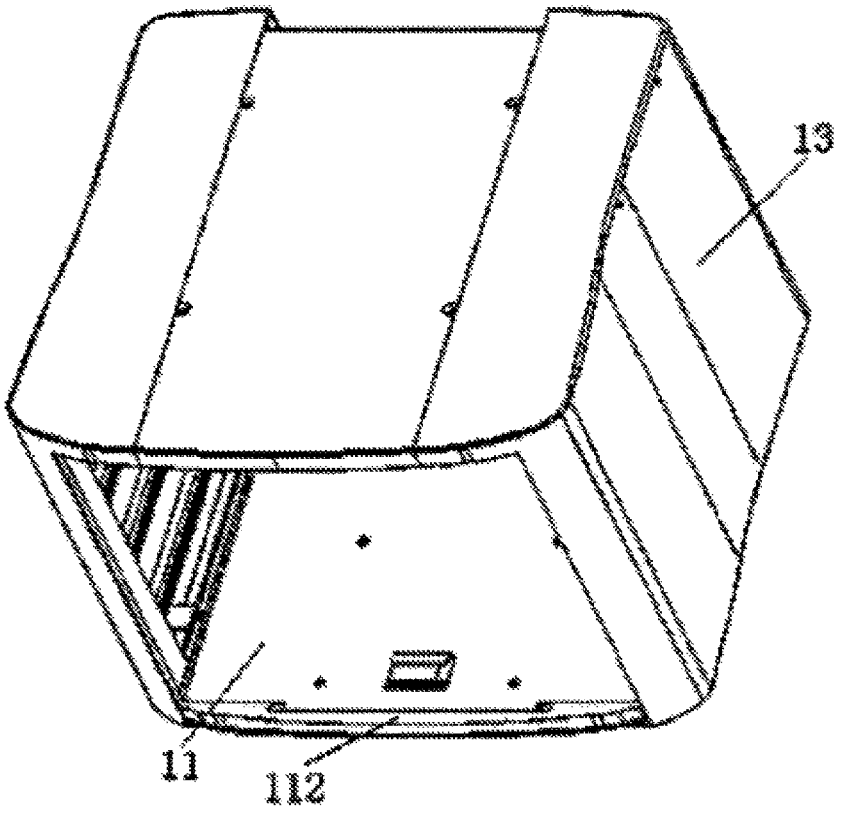
FIG. 3 is a schematic diagram of a medical case housing according to the present invention.
Figure 4:
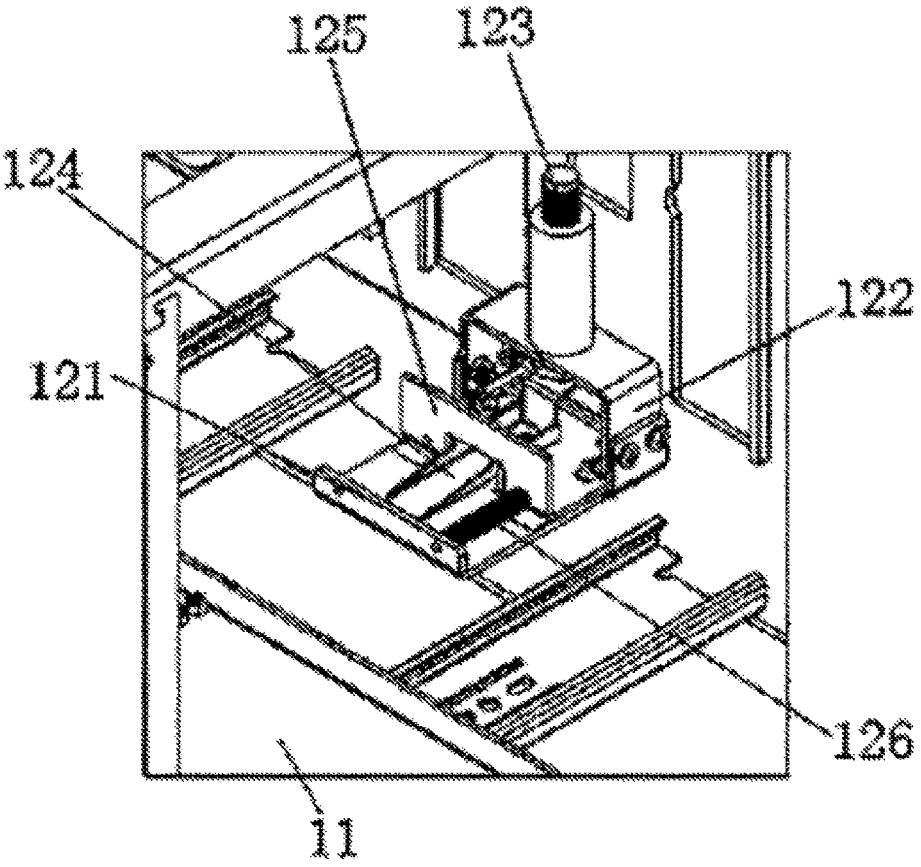
FIG. 4 is a schematic diagram of a tray lock according to the present invention.
Figure 5:
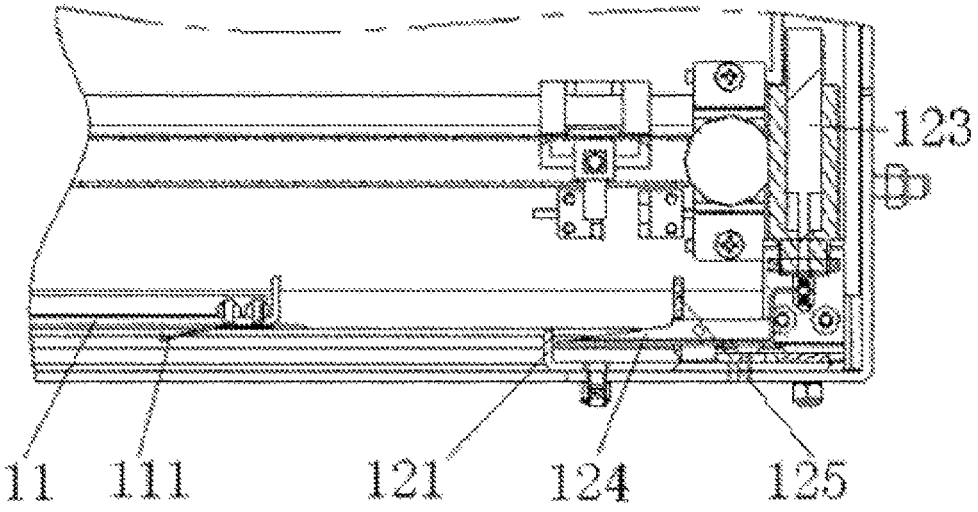
FIG. 5 is schematic diagram of separating a tray and the tray lock according to the present invention.
Figure 6:
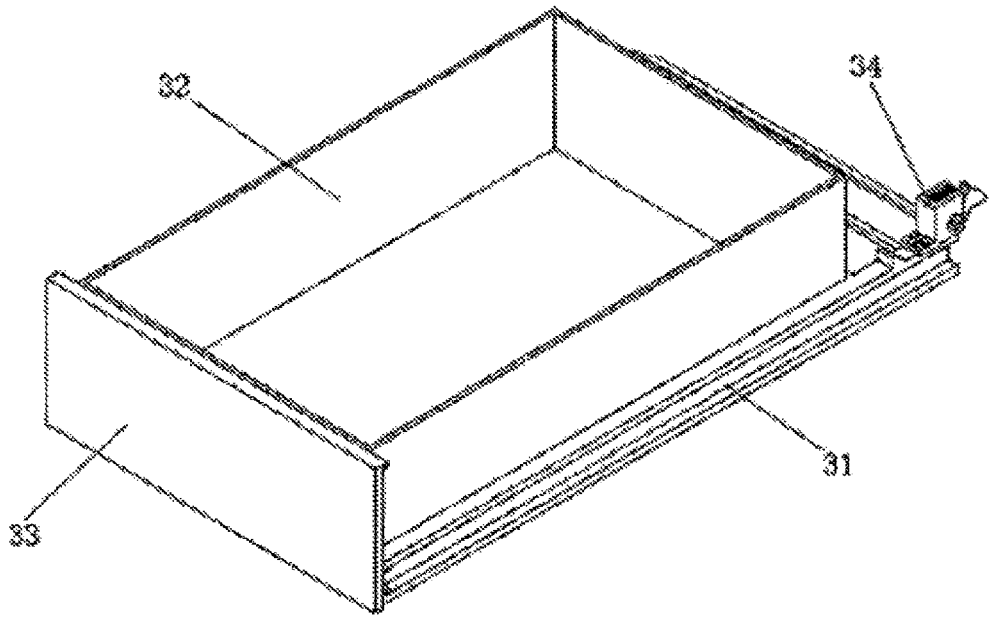
FIG. 6 is a schematic diagram of drawers according to the present invention.
Figure 7:
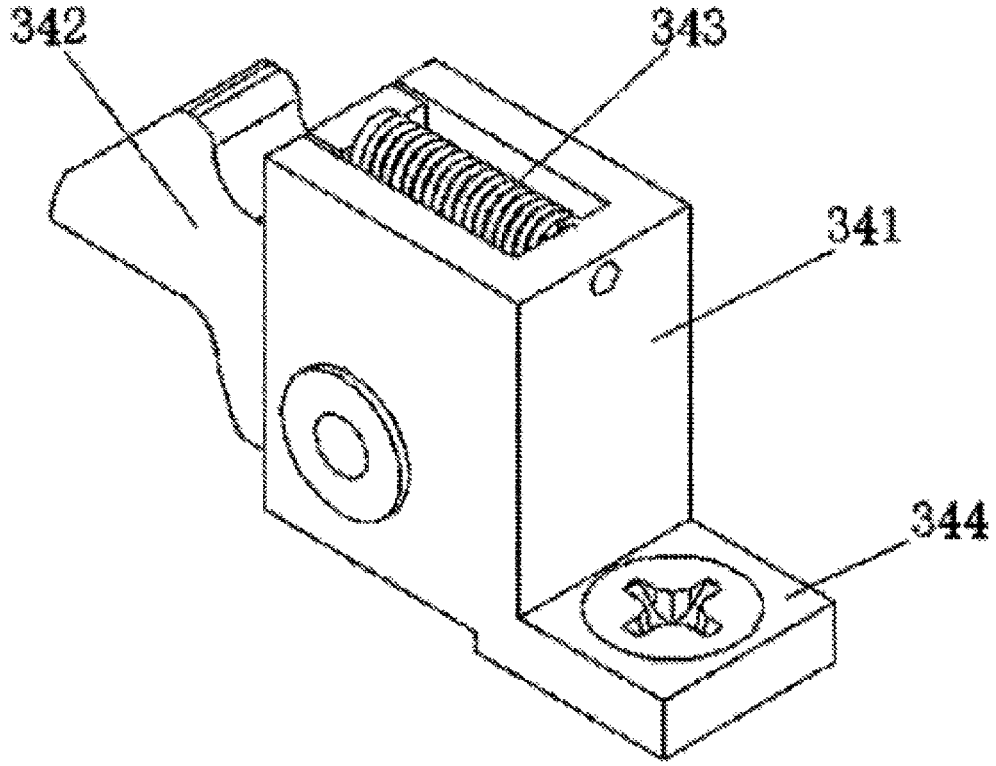
FIG. 7 is a schematic diagram of a coupling mechanism according to the present invention.
Figure 8:
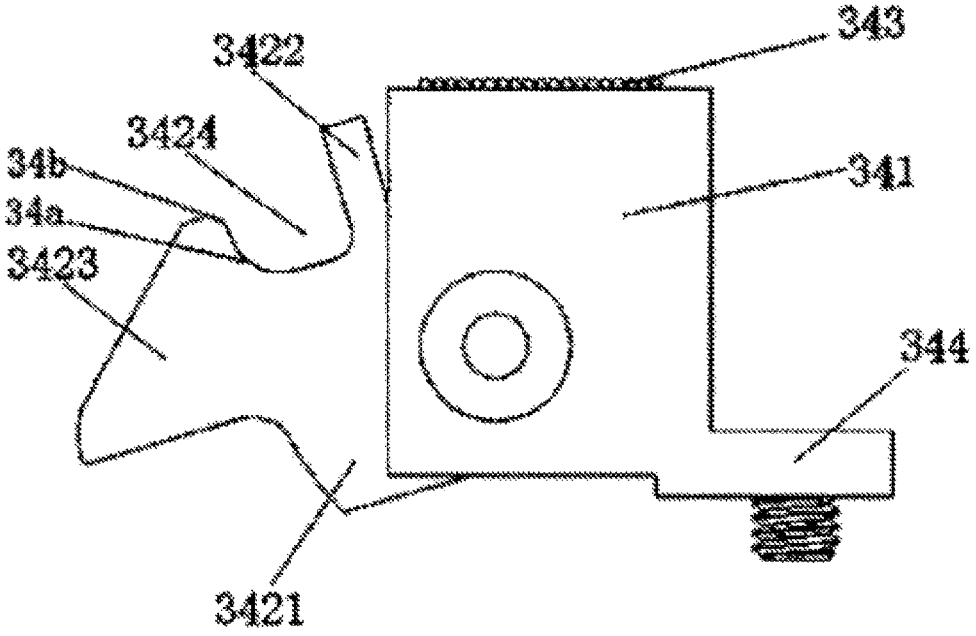
FIG. 8 is a vertical view of the coupling mechanism according to the present invention.
Figure 9:
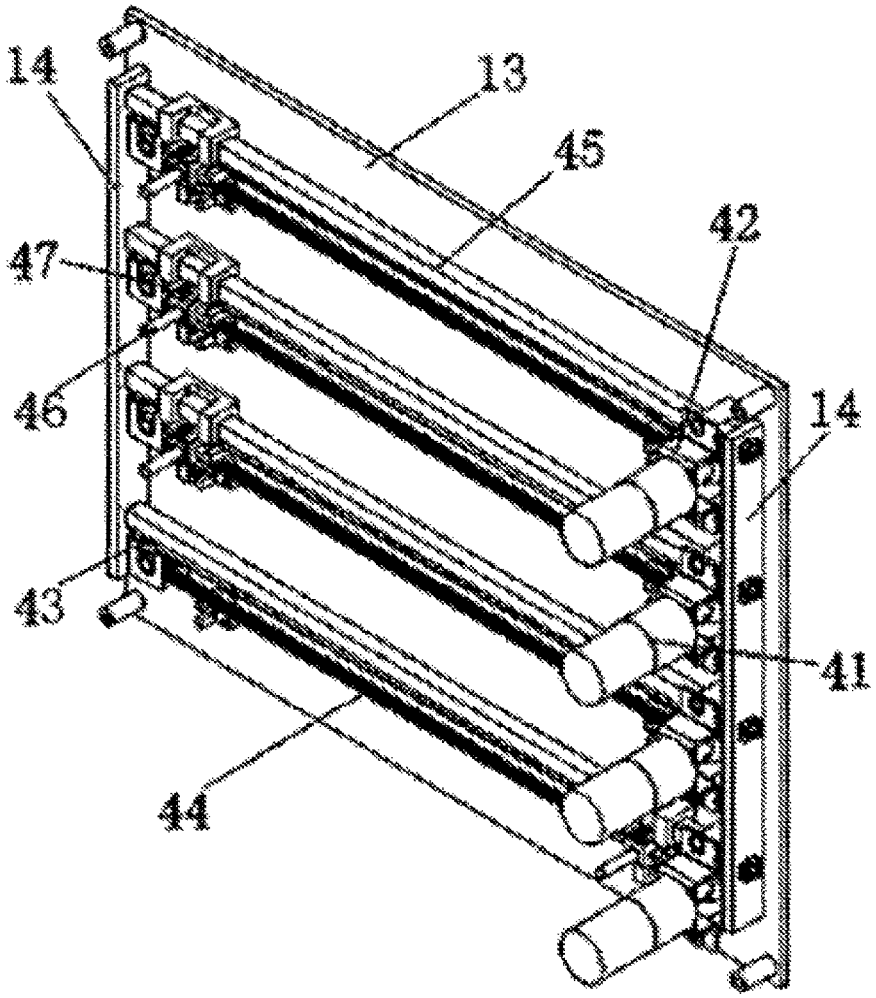
FIG. 9 is a schematic diagram of installing a drawer driving device on the medical case housing according to the present invention.
Figure 10:
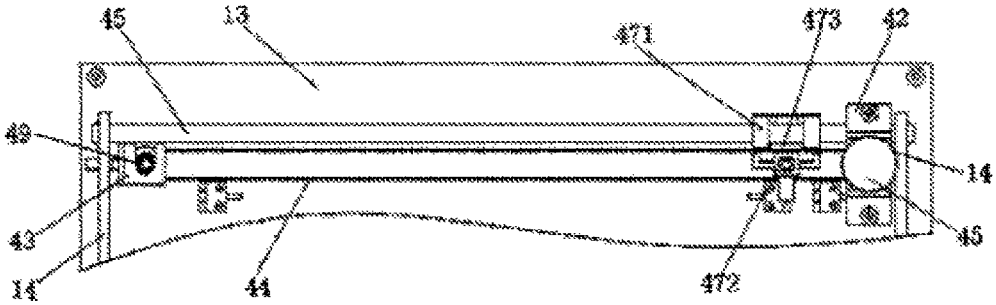
FIG. 10 is a vertical view of installing the drawer driving device on the medical case housing according to the present invention.
Figure 11:
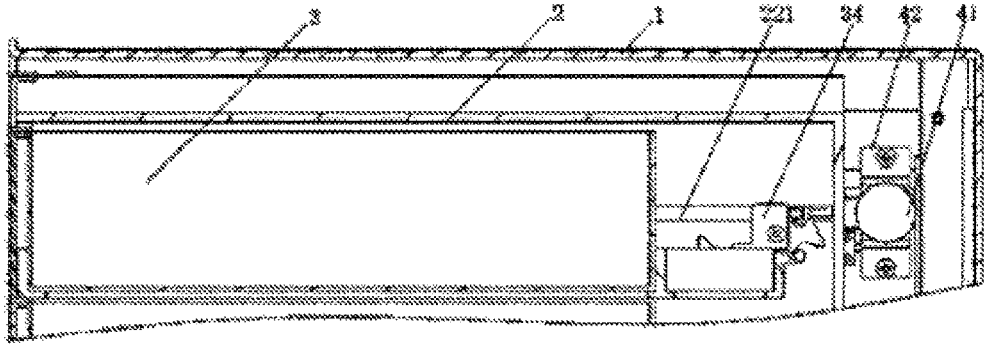
FIG. 11 is a schematic diagram of matching between the drawer driving device and the coupling mechanism when the drawers are installed inside the medicine box and the medicine box is installed inside the medical case housing according to the present invention.

A movable medical case, as shown in FIG. 1 to FIG. 11, includes a medical case housing 1, a medicine box 2 and drawers 3, wherein drawer driving devices are installed in the medical case housing, and the drawer driving devices pass through the medicine box 2, are detachably connected with the drawers 3, and drive the drawers 3 to get out of or enter the medical case housing 1.

The medicine box 2 is installed inside the medical case housing 1 and is detachably connected with the medical case housing medical case housing 1. The medical case housing 1 is a square case body with an open front end, a tray lock is arranged in the bottom surface inside the medical case housing 1, a tray 11 in slide fit with the two side walls 13 of the medical case housing 1 is arranged above the bottom surface of the medical case housing 1, and the bottom surface of the tray 11 is provided with an elastic hook 111 matched with the tray lock. One end of the tray 11 close to the medical case housing 1 is provided with a baffle 112 vertical to the tray 11, the medicine box 2 is placed in the tray 11 and is pushed into the medical case housing 1 together with the tray 11, and the elastic hook 111 is matched with the tray lock to fix the medicine box 2 in the medical case housing 1. When the medicine box 2 needs to be taken out, the elastic hook 111 is separated from the tray lock, then the tray 11 is ejected automatically, so that the medicine box 2 can be taken out.

The tray lock includes a bottom plate 121, a bracket 122, a connecting rod 123, a paddle 124, a push pedal 125 and a spring 126. The bottom plate 121 is a square plate sheet fixed in a middle position at the rear end inside the medical case housing 1, and the front end of the bottom plate 121 is provided with a latch plate arranged vertically to the bottom plate 121. The bracket 122 is an inverse U-sheet, and the two ends of the bracket are fixedly connected with the bottom plate 121. The push pedal 125 is installed in the top surface of the bottom plate 121, and is in slide fit with the bottom plate 121, the front end of the push pedal 125 is provided with a bending portion which upwardly extends along a direction vertical to the push pedal 125, and the front end of the bending portion is connected with the latch plate of the bottom plate 121 through a spring 126. A hole is arranged in the middle position of the bending portion, and the paddle 124 passes through the hole. The paddle 124 is zigzag, wherein a relatively long portion of the paddle 124 is arranged in the lower side while a relatively short portion thereof is arranged in the top side, the relatively long portion passes through the hole in the push pedal 125 to the latch plate, and the bottom portion of the paddle 124 is articulated with the bottom plate 121. The relatively short portion is fixedly connected with the bottom end of the connecting rod 123 above thereof which passes through the bracket 122. The top end of the connecting rod 123 passing through a sleeve fixedly installed in the top end of the bracket 122 is connected with an electromagnetic device, and the bottom end of the connecting rod is fixedly connected with the paddle 124.

The middle position at the rear end of the tray 11 is provided with a square hole, the rear end of the elastic hook 111 in the tray 11 is fixed at the rear end of the square hole in the tray 11, and the front end of the tray 11 leans towards the lower-front under a nature state.

When the tray 11 is pushed to move towards the inside of the medical case housing 1, the rear end of the tray 11 pushes the bending portion of the push pedal 125 to move backwards, and the front end of the elastic hook 111 is clamped inside the latch plate, so that the tray 11 is locked tightly under the effect of the restoring force of the spring 126. When the tray 11 needs to be ejected, the electromagnetic device drives the connecting rod 123 to move downwards, so as to drive the relatively long portion of the paddle 124 to upwarp, and push the elastic hook 111 to separate from the latch plate, so that the tray 11 is ejected under the effect of the push pedal 125.

The drawers are installed inside the medicine box 2, and the number of the drawers may be specifically set according to the service conditions of the medical case housing 1, so as to adjust the structure of the medicine box 2. In the embodiment, eight drawers 3 are arranged. The medicine box 2 is set as a square box body structure with an open front end, the eight drawers 3 are divided into four layers, and are symmetrically installed at the two sides of the inside of the medicine box 2.

The transverse middle of the medicine box 2 is provided with a vertical baffle 21, the two sides of the vertical baffle 21 are provided with four rows of roller wheels 211 from the top to the bottom, each row of roller wheels 211 are arranged along the front and back directions of the medicine box 2, and four rows of roller wheels 211 are also arranged on the positions of the two side walls 22 of the medicine box 2 corresponding to the roller wheels 211 in the vertical baffle 21 respectively. Both the two sides of the drawer 3 are provided with a runner 31; during installation, the two runners 31 are matched with the roller wheels 211 in the side walls 22 and the vertical baffle 21 of the medicine box 2 respectively, to guide and support the drawer 3 during the process of entering and getting out of the medicine box 2. The vertical middle position of the medicine box 2 is provided with a transverse baffle 23.

A through groove 221 extending along the front and back directions of the medicine box 2 is arranged above the two side walls 22 of the medicine box 2 and each row of roller wheels 211, wherein the through groove 221 extends till the back wall 23 of the medicine box 2 to ensure that the drawer driving device will not be blocked by the back wall 23 of the medicine box 2 when the drawer driving device passes through and is moved out from the through groove 221.

The drawer 3 includes a storage box 32, a cover plate 33 at the front end of the storage box 32 and detachably connected with the storage box 32, the runners 31 at the two sides of the storage box 32, and a coupling mechanism 34 installed at the top portion of the rear end of the runner close to one side of the side wall 13 of the medicine box 2.

The position of the coupling mechanisms 34 is corresponding to the position of the through groove 221 in the storage box 32. The coupling mechanism 34 includes a bracket 341, a hook plate 342 and a return spring 343. The bracket 341 is a plate with a U-shaped cross section, wherein an opening thereof faces towards the rearward of the drawer 3, and a bottom portion thereof is fixed in the runner 31 at the rear end of the drawer 3 through a plate sheet. The hook plate 342 includes an articulation portion 3421, a connecting block 3422 and a wedged-head portion 3423, the articulation portion 3421 is located in the lower portion of the hook plate 342, stretches into the bracket 341 and is articulated with the lower portion of the bracket 341. The connecting block 3422 and the wedged-head portion 3423 are located in the top portion of the hook plate 342, the connecting block 3422 is located at one side close to the bracket 341, a holding groove 3424 is formed between the connecting block 3422 and the wedged-head portion 3423, and the holding groove 3424 is matched with a connecting rod 46 of the drawer driving device. The return spring 343 is installed at the top portion inside the bracket 341, the position of the return spring is corresponding to the position of the connecting block 3422, one end of the return spring is fixed in the bracket 341, and the other end is connected with the connecting block 3422. The portion of the holding groove 3424 close to the wedged-head portion 3423 forms an arc 34*a* bent towards the inside of the holding groove 3424, to ensure that the coupling rod 46 will not be disengaged from the holding groove 3424 when the coupling rod is pushing the wedged-head portion 3423 in a certain range of an acting force. The transition between the portion of the holding groove 3424 close to the wedged-head portion 3423 and the top surface of the wedged-head portion 3423 is arc transition 34*b*, to ensure that the coupling rod 46 can be smoothly disengaged from the holding groove 3424 under a certain acting force.

The drawer driving devices are installed in the two side walls 13 of the medical case housing 1, and the number of the drawer driving devices is corresponding to the number of the drawers 3. In the embodiment, eight drawer driving devices are arranged, divided into four layers, and installed in the side walls 13 of the medical case housing 1. Each drawer driving device includes a motor 41, a motor support 42, two synchronous belt wheels, a synchronous belt wheel installing groove 43, a synchronous belt 44, a guide rod 45, a coupling rod 46 and a coupling rod fixed mount 47.

The motor support 42 is a U-shaped plate, and an opening of the motor support 42 faces towards the side wall 13 of the medical case housing 1 and is installed at the rear end of the side wall 13 of the medical case housing 1. A drive rod of the motor 41 passes through the motor support 42 along a direction vertical to the side wall 13 of the medical case housing 1, and is connected with the synchronous belt wheels 49 in the motor support 42, and a housing of the motor 41 is fixedly connected with the motor support 42.

The synchronous belt wheel installing groove 43 is a U-shaped plate, an inserting rod 431 is arranged along a direction vertical to the bending portion thereof, and groove openings 432 are arranged on the two side walls thereof along a direction vertical to the opening thereof. A vertical inserting plate 14 is arranged at the front end of the medical case housing 1 close to the opening position, the synchronous belt wheel installing groove 43 is arranged inside the medical case housing 1, and the groove opening 432 thereof is upward, and the inserting rod 431 is vertically inserted into the inserting plate 14 for fixation. The synchronous belt wheels 49 are installed in the synchronous belt wheel installing groove 43, and the two ends of a neutral axis thereof are arranged in the groove openings 432 in the two side walls 13 of the synchronous belt wheel installing groove 43 respectively. The synchronous belt 44 is installed in the two synchronous belt wheels 49.

The vertical inserting plates 14 are installed at the rear end of the side wall 13 of the medical case housing 1 and behind the installation position of the motor 41. The guide rod 45 is horizontally arranged above the synchronous belt 44, and the two ends thereof are inserted into the inserting plates 14 at the front end and the rear end of the side wall 13 respectively.

The coupling rod fixed mount 47 includes a sliding block 471 and a coupling rod pedestal 472. The sliding block 471 is sheathed on the guide rod 45 and is in slide fit with the guide rod 45. A horizontally arranged installing plate 473 is installed in the bottom portion of the sliding block 471, the coupling rod pedestal 472 is arranged below the installing plate 473 and is connected through bolts, and the synchronous belt 44 is arranged between the installing plate 473 and the coupling rod pedestal 472 and is clamped. The coupling rod 46 is vertically fixed in the coupling rod pedestal 472 along a direction vertical to the side wall 13 of the medical case housing 1, and the position of the coupling rod 46 is corresponding to the through groove 221 in the medicine box 2 and the coupling mechanism 34 in the drawer 3.

The motor 41 drives the synchronous belt wheels 49, the synchronous belt 44 and the coupling rod fixed mount 47 to move, so as to drive the coupling rod 46, the coupling mechanism 34 and the drawers 3 to move. The length of the synchronous belt 44 between the two synchronous belt wheels 49 is greater than the length of the drawer 3.

A manner of connecting the coupling mechanism 34 in the drawer 3 with the coupling rod 46 of the drawer driving device is as follows: when the medicine box 2 is installed inside the medical case housing 1, and the drawers 3 are located inside the medicine box 2 and under a closed state, the coupling rod 46 moves towards the position of the drawers 3 under the drive of the motor 41 to extrude the top surface of the wedged-head portion 3423, so as to drive the installing plate 473 to extrude the return spring 343 until the coupling rod 46 enters the inside of the holding groove 3424, and the hook plate 342 is rebounded under the effect of the return spring 343, thus completing the match between the coupling mechanism 34 and the coupling rod 46.

When the medicine box 2 is placed in the medical case housing 1 for use, the operation of the motor 41 is controlled to ensure that the drawer 3 is opened and closed in a certain range and the coupling rod 46 is matched with the coupling mechanism 34 all the time.

A method of separation between the coupling mechanism 34 and the coupling rod 46 is as follows: when the medicine box 2 is installed inside the medical case housing 1, the drawers 3 are arranged inside the medicine box 2 and under a closed state, and the coupling rod 46 is matched with the coupling mechanism 34, the coupling rod 46 moves opposite to the position of the drawers 3 until being separated from the coupling mechanism 34. After separation, the return spring 343 drives the hook plate 342 to rebound.

After the coupling rod 46 is separated from the coupling mechanism 34, the tray lock is opened, and the tray 11 is pulled to the outside of the medical case housing 1, so that the medicine box 2 can be taken out.

The movable medical case according to the present invention may implement detachable connection between the medical case housing and the medicine box. When the medical case is installed in a workstation, the medicine box may be taken out to dispense medicines at a dispensing station, and then put back to the medical case. When the medical case is installed in the medical case housing, the drawers may be ejected automatically by controlling the drawer driving devices; when the medicine box needs to be taken out of the medical case housing or putted into the medical case housing, the automatic separation and connection between the drawers and the drawer driving devices can also be implemented. The medical case is simple in structure, and reasonable in arrangement, and is applicable to the automation control demands of a mobile medical computer workstation.

The invention claimed is:

1. A movable medical case comprising a medical case housing, a medicine box, a tray and drawers, said tray locatable inside said medical case housing when said tray is pushed into said medical case housing, said tray pullable out of said medical case housing, wherein:

said medicine box is separably installed on the tray, said medicine box pullable out and pushable into said medical case housing with said tray, the drawers are installed inside the medicine box, the medicine box is installed inside the medical case housing, and drawer driving devices are installed in the medical case housing, the drawer driving devices pass through the medicine box and are separably connected with the drawers, and drive the drawers to get out of or enter the medical case housing, wherein a coupling mechanism is installed at the rear end of the drawer, at least one of the drawer driving devices is installed on the side wall inside the medical case housing, comprising a motor, a synchronous belt, two synchronous belt wheels and a coupling rod, the motor is installed in the medical case housing to drive the synchronous belt wheels to rotate so as to drive the synchronous belt to move, and the coupling rod is installed in the synchronous belt and is removably couplable with a coupling mechanism of one of the drawers with which the coupling rod is associated, wherein, when the medical box is placed in the medical case housing, the coupling rod is fixed on the synchronous belt and is connected with the coupling mechanism of said one of the drawers, and wherein, when the drawer driving device separates the coupling rod from the coupling mechanism, the medicine box is removable from the medical case housing.

2. The movable medical case according to claim 1, wherein an elastic hook is installed on said tray, and a tray lock is installed in said medical case housing, the elastic hook cooperates with tray lock to lock the tray inside medical case housing or unlock it.

3. The movable medical case according to claim 1, wherein the drawer driving device further comprises a guide rod and a coupling rod fixed mount, the guide rod is fixed in the side wall of the medical case housing, the coupling rod fixed mount comprises a sliding block sheathed on the guide rod and a coupling rod pedestal fixed in the bottom portion of the sliding block, the synchronous belt is clamped between the sliding block and the coupling rod fixed mount, and the coupling rod is fixed in the coupling rod pedestal.

4. The movable medical case according to claim 1, wherein the coupling mechanism comprises a bracket, a hook plate and a return spring, the bracket is a plate with a U-shaped cross section, wherein an opening thereof faces towards the rearward of the drawer, and a bottom portion thereof is fixed in the rear end of the drawer, the hook plate comprises an articulation portion, a connecting portion and a wedged-head portion, the articulation portion is located at the lower portion of the hook plate and is articulated with the lower portion of the bracket, the connecting portion and the wedged-head portion are located at the top portion of the hook plate, the connecting portion is located at one side close to the bracket, a holding groove is formed between the connecting portion and the wedged-head portion, and the holding groove is matched with the coupling rod, and the return spring is installed at the top portion inside the bracket, the position of the return spring is corresponding to the position of the connecting portion, one end of the return spring is fixed in the bracket, and the other end is connected with the connecting portion.

5. The movable medical case according to claim 4, wherein the portion of the holding groove close to the wedged-head portion forms an arc bent towards the inside of the holding groove.

6. The movable medical case according to claim 4, wherein the transition between the portion of the holding groove close to the wedged-head portion and the top surface of the wedged-head portion is arc transition.

* * * * *